US012234691B2

(12) United States Patent
Al-Jasim et al.

(10) Patent No.: US 12,234,691 B2
(45) Date of Patent: Feb. 25, 2025

(54) TAPERED WELLHEAD SPACER SPOOL FOR WELLBORE OPERATIONS

(71) Applicant: Saudi Arabian Oil Company, Dhahran (SA)

(72) Inventors: Ali Jasim Al-Jasim, Al-Hofuf (SA); Ahmed Alabdulmohsen, Al-Hofuf (SA); Ibrahim M. Najie, Al-Hofuf (SA); Mohammad Abdurahman Nuaim, Al-Hofuf (SA); Sultan Abdulwahab AlShehri, Jedda (SA)

(73) Assignee: Saudi Arabian Oil Company, Dhahran (SA)

( * ) Notice: Subject to any disclaimer, the term of this patent is extended or adjusted under 35 U.S.C. 154(b) by 147 days.

(21) Appl. No.: 17/895,646

(22) Filed: Aug. 25, 2022

(65) Prior Publication Data

US 2024/0068304 A1 Feb. 29, 2024

(51) Int. Cl.

| | |
|---|---|
| ***E21B 33/03*** | (2006.01) |
| ***E21B 3/04*** | (2006.01) |
| ***E21B 17/10*** | (2006.01) |
| ***E21B 17/20*** | (2006.01) |
| ***E21B 33/04*** | (2006.01) |
| ***E21B 33/068*** | (2006.01) |

(52) U.S. Cl.

CPC ..... *E21B 17/10* (2013.01); *E21B 17/20* (2013.01); *E21B 33/03* (2013.01); *E21B 33/04* (2013.01); *E21B 33/068* (2013.01)

(58) Field of Classification Search

CPC ..... E21B 33/03; E21B 33/04; E21B 33/068

See application file for complete search history.

(56) References Cited

U.S. PATENT DOCUMENTS

| | | | | |
|---|---|---|---|---|
| 2004/0094305 | A1 | 5/2004 | Skjærseth et al. | |
| 2021/0079750 | A1* | 3/2021 | Skjold | E21B 47/13 |
| 2023/0109806 | A1* | 4/2023 | Santin | E21B 43/12 166/305.1 |

OTHER PUBLICATIONS

SAIP Examination Report in Saudi Arabian Appln. No. 123450212, dated Nov. 7, 2024, 12 pages (with English Translation).

* cited by examiner

*Primary Examiner* — Giovanna Wright
(74) *Attorney, Agent, or Firm* — Fish & Richardson P.C.

(57) ABSTRACT

A wellbore tool includes a wellhead to be installed at an entrance to a wellbore formed through a subterranean zone. The wellhead includes an uphole wellhead end that can extend upward from the entrance, and a downhole wellhead end that can extend downhole into the wellhead. The wellhead defines an opening extending from the uphole wellhead end to the downhole wellhead end. A spacer tool is attached to the downhole wellhead end, and includes an uphole spacer tool end and a downhole spacer tool end. The spacer tool defines a tapered opening tapering from end to end. The tool includes a master valve attached to the downhole spacer tool end of the spacer tool. The master valve defines a flow pathway fluidically coupled to the opening defined by the wellhead and the tapered opening defined by the spacer tool.

12 Claims, 3 Drawing Sheets

TAPERED WELLHEAD SPACER SPOOL FOR WELLBORE OPERATIONS

TECHNICAL FIELD

This disclosure relates to wellbore operations, for example, wellbore intervention operations.

BACKGROUND

Wellbore intervention operations include wellbore operations performed to safely enter a wellbore, with well control, to perform a variety of tasks other than drilling. Wellbore intervention is performed when an undesirable condition is identified at a downhole location within a wellbore, and action needs to be taken to modify the undesirable condition into an acceptable condition. Wellbore intervention operations involve lowering tools into the wellbore, through equipment that has previously been disposed or installed within the wellbore. In some instances, tools can be lowered on coiled tubing. Coiled tubing is a continuous length of tubing (or tubular or pipe) on a spool. Before insertion into the wellbore, the tubing is unwound from the spool and straightened. After use, the tubing is wound to the spool and can be easily transported. Any wellbore intervention tool can be attached to an end of the coiled tubing and lowered into the wellbore. An obstruction-free path through the equipment already disposed within the wellbore will ensure easy passage of the tool and the coiled tubing.

SUMMARY

This disclosure describes technologies related to tapered wellhead spacer spool for wellbore operations.

Certain aspects of the subject matter described here can be implemented as a wellbore tool. The tool includes a wellhead configured to be installed at an entrance to a wellbore formed through a subterranean zone. The wellhead includes an uphole wellhead end that can extend upward from the entrance, and a downhole wellhead end that can extend downhole into the wellhead. The wellhead defines an opening extending from the uphole wellhead end to the downhole wellhead end. The tool includes a spacer tool attached to the downhole wellhead end. The spacer tool includes an uphole spacer tool end attached to the downhole end of the wellhead and a downhole spacer tool end extending downhole into the wellbore. The spacer tool defines a tapered opening tapering from the uphole spacer tool end toward the downhole spacer tool end. The tool includes a master valve attached to the downhole spacer tool end of the spacer tool. The master valve defines a flow pathway fluidically coupled to the opening defined by the wellhead and the tapered opening defined by the spacer tool.

An aspect combinable with any other aspect includes the following features. An inner diameter of the tapered opening at the uphole spacer tool end is greater than inner diameter of the tapered opening at the downhole spacer tool end.

An aspect combinable with any other aspect includes the following features. The tool includes coiled tubing that can be lowered through the wellbore tool to a downhole location downhole of the master valve.

An aspect combinable with any other aspect includes the following features. An outer diameter of the coiled tubing is less than the inner diameter of the tapered opening at the downhole spacer tool end.

An aspect combinable with any other aspect includes the following features. The tool includes a well tool attached to an end of the coiled tubing and configured to be lowered through the wellbore tool to the downhole location.

An aspect combinable with any other aspect includes the following features. An outer diameter of the downhole tool is less than the inner diameter of the tapered opening at the downhole spacer tool end.

An aspect combinable with any other aspect includes the following features. An inner diameter of the tapered opening decreases from the uphole spacer tool end toward the downhole spacer tool end to form a substantially smooth tapered opening without shoulders protruding radially inward into the tapered opening.

Certain aspects of the subject matter described here can be implemented as a method. A wellbore tool, as described in this disclosure, is formed. The wellbore tool is installed within the wellbore.

An aspect combinable with any other aspect includes the following features. The spacer tool is formed to have an inner diameter decrease from the uphole spacer tool end toward the downhole spacer tool end, forming a substantially smooth tapered opening without shoulders protruding radially inward into the tapered opening.

An aspect combinable with any other aspect includes the following features. The spacer tool is formed to have an inner diameter at the uphole spacer tool end greater than an inner diameter of the tapered opening at the downhole spacer tool end.

An aspect combinable with any other aspect includes the following features. A coiled tubing is formed. An outer diameter of the coiled tubing is less than the inner diameter of the tapered opening at the downhole spacer tool end. The coiled tubing is passed through the wellbore tool to a downhole location within the wellbore.

An aspect combinable with any other aspect includes the following features. A well tool is attached to an end of the coiled tubing. An outer diameter of the well tool is less than the inner diameter of the tapered opening at the downhole spacer tool end. The well tool attached to the end of the coiled tubing is lowered through the wellbore tool to the downhole location.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Wellbore intervention operations include wellbore operations performed to safely enter a wellbore, with well control, to perform a variety of tasks other than drilling. Wellbore intervention operations occupy a major part of oil and gas daily operations. Such operations are executed to maintain well production, logs, a well control and to obtain downhole condition overview. Coiled tubing (CT) is one example of wellbore intervention equipment with several capabilities. In some instances, coiled tubing is passed into the wellbore and through well equipment installed within the wellbore to access downhole locations. Sometimes, when passing through the wellbore, the coiled tubing goes from one uphole equipment (e.g., a wellhead or a frac tree) into a downhole equipment (e.g., a lower manual master valve) downhole of the uphole equipment. If the opening in the downhole equipment differs in size from the opening in the uphole equipment, then the decrease in diameter can cause difficulties to pass the coiled tubing to the downhole location. Such difficulties can be aggravated if the up whole equipment and the downhole equipment are spaced apart, i.e., not attached end to end.

This disclosure describes a wellbore spacer tool that can be installed between the up whole equipment and the downhole equipment, as described earlier, that can ease passing the coiled tubing to the downhole location through both the equipment. As described below with reference to the following figures, the wellbore spacer tool includes a tapered opening, which tapers in the downhole direction, such that the tapered opening guides the coiled tubing as the coiled tubing process from the up whole equipment into the downhole equipment. In this manner, the wellbore spacer described here can allow easy access of downhole equipment using coiled tubing and can eliminate creating any shoulders or size obstructions due to different inner diameters of the different equipment through which the coiled tubing process.

Figure 1:
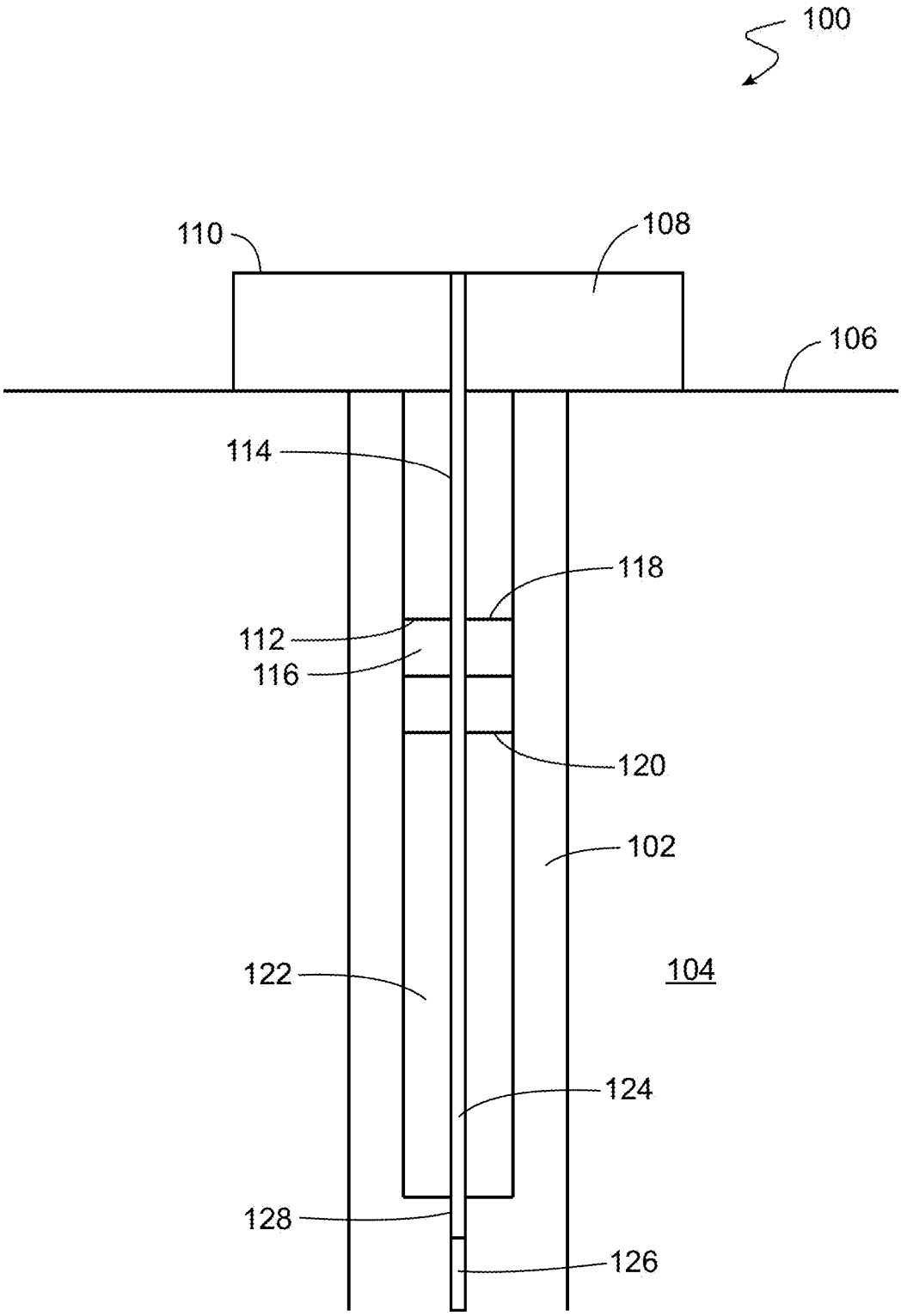
FIG. 1 is a schematic diagram of a wellbore system.

FIG. 1 is a schematic diagram of a wellbore system 100, which includes a wellbore 102 formed through a subterranean zone 104 (e.g., a formation, a portion of a formation or multiple formations) from a surface 106 to a reservoir (not shown) bearing hydrocarbons. The wellhead 108 is installed at an entrance to the wellbore 102. The wellhead 108 includes multiple equipment such as spools, valves, adapters and other equipment that operated to provide pressure control of the wellbore 102. The wellhead 108 includes an uphole wellhead end 110 and a downhole wellhead end 112. The uphole wellhead end 110 can be positioned above the surface 106 of the wellbore 102. The downhole wellhead end 112 can be disposed within the wellbore 102 at a downhole location. The wellhead 108 defines an opening 114 extending from the uphole wellhead end 110 to the downhole wellhead end 112. A dimension (e.g., an inner diameter) of the opening 112 can be large enough to allow well intervention tools such as coiled tubing 128 and well tools (e.g., the well tool 126) attached to the coiled tubing 128 to pass through the opening 114. In some implementations, the inner diameter of the opening 112 is 5⅛ inches.

The wellbore system 100 includes a spacer tool 116 attached to the downhole wellhead end 112 of the wellhead 108. The spacer tool 116 includes an uphole spacer tool end 118 and a downhole spacer tool end 120. The uphole spacer tool end 118 is attached to the downhole wellhead end 112, and the downhole spacer tool end 120 is downhole of the uphole spacer tool end 118. The spacer tool 116 defines a tapered opening (FIG. 2) the tapers from the uphole spacer tool end 118 towards the downhole spacer tool end 120.

The wellbore system 100 includes a master valve 122 attached to the downhole spacer tool end 120. In some implementations, the master valve controls all flow through the wellbore 102. The master valve 122 defines a flow pathway 124 that fluidically couples to the opening defined by the wellhead 108 and the tapered opening defined by the spacer spool 116. A dimension (e.g., an inner diameter) of the flow pathway 124 can be large enough to allow well intervention tools such as coiled tubing 128 and well tools (e.g., well tool 126) attached to the coiled tubing 128 to pass through the flow pathway 124.

Figure 2:
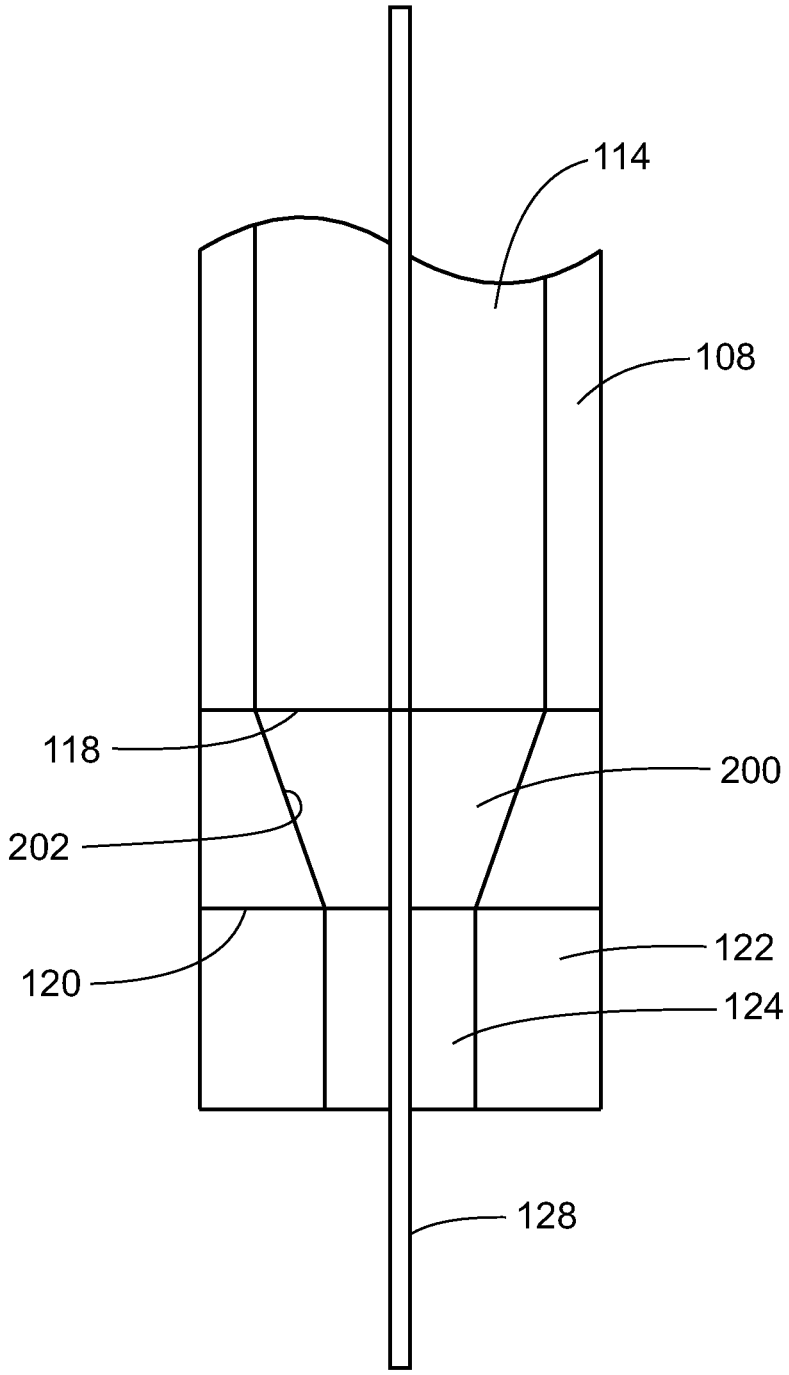
FIG. 2 is a schematic diagram of a spacer tool installed in the wellbore system of FIG. 1.

FIG. 2 is a schematic diagram of a spacer tool 116 installed in the wellbore system of FIG. 1. As described above, the spacer tool 116 includes a tapered opening 200 extending from the uphole spacer tool end 118 to the downhole spacer tool end 120. An inner diameter of the tapered opening 200 at the uphole spacer tool end 118 is greater than an inner diameter of the tapered opening 200 at the downhole spacer end 120. In some implementations, the inner diameter of the tapered opening 200 at the downhole spacer end 120 is equal to the inner diameter of the fluid flow pathway 124 through the master valve 122, e.g., 4 1/16 inches. The inner diameter of the tapered opening 200 decreases from the uphole spacer tool end 118 toward the downhole spacer tool end 120 to form a substantially smooth tapered opening without shoulders protruding radially into the tapered opening 200. In the context of this disclosure, "substantially smooth tapered opening" means that an inner surface 202 of the tapered opening 200 does not have any sharp edges or protrusions on which the coiled tubing 128, the downhole tool 124, or any other well equipment that is passed through the tapered opening 200 can catch. In the absence of the spacer tool 116, the wellhead 108 and the master valve 122 can either be in direct contact with each other or be spaced apart. In such instances, because an inner diameter of the opening 114 at the downhole wellhead end 112 is different from (specifically, smaller than) an inner diameter of the flow pathway 124 at an uphole end of the master valve 122, any well equipment passed through the opening 114 can encounter a shoulder preventing easy passage of the well equipment into the flow pathway 124. By introducing the spacer tool 116 described in this disclosure, a smooth, tapered passage is provided for the well equipment to pass easily from the opening 114 in the wellhead 108 into the flow pathway 124 in the master valve 122. In addition to providing the tapered opening 200, the spacer tool 116 is designed to meet API standards and to withstand high pressure, e.g., up to 10,000 psi.

Returning to FIG. 1, in some implementations, the wellbore system 100 can include the coiled tubing 128 that can be lowered through the spacer tool 116 to a downhole location downhole of the master valve 122. As described above, an outer diameter of the coiled tubing 128 is less than the inner diameter of the tapered opening 200 at the downhole spacer tool end 120. In some implementations, the wellbore system 100 can include the wellhead tool 126 attached to an end of the coiled tubing 128 to be lowered through the spacer tool 116 to the downhole location. An outer diameter of the downhole tool 126 is less than the inner diameter of the tapered opening 200 at the downhole spacer tool end 120.

Figure 3:
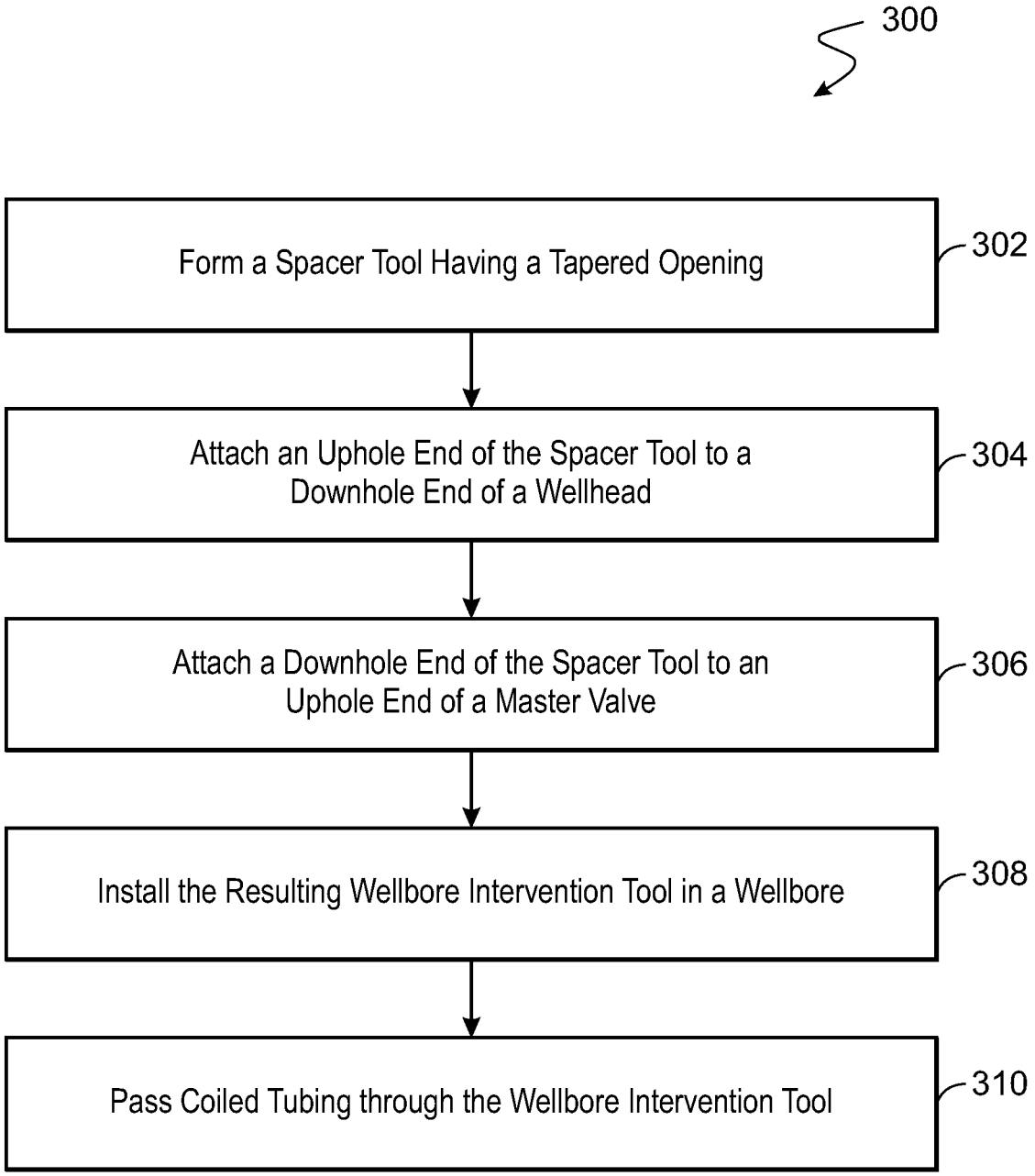
FIG. 3 is a flowchart of an example of a process of implementing the spacer tool of FIG. 2.

FIG. 3 is a flowchart of an example of a process 300 of implementing the spacer tool 116. In some implementations, the process 300 can be performed by an operator of a wellbore system, e.g., the wellbore system 100. At 302, a spacer tool, e.g., the spacer tool 116, having a tapered opening, e.g., the tapered opening 200, is formed. At 304, an uphole end of the spacer tool is attached to a downhole end of a wellhead, e.g., the wellhead 108. At 306, a downhole end of the spacer tool is attached to an uphole end of a master valve, e.g., the master valve 122. At 308, the resulting wellbore intervention tool is installed in a wellbore, e.g., the wellbore 102. At 310, coiled tubing, e.g., the coiled tubing 128, is passed through the wellbore intervention tool. As described above, the tapered opening of the spacer tool facilitates passage of the coiled tubing through the wellhead and into the master valve to downhole locations within the wellbore.

Thus, particular implementations of the subject matter have been described. Other implementations are within the scope of the following claims.

The invention claimed is:

1. A wellbore tool comprising:

a wellhead configured to be installed at an entrance to a wellbore formed through a subterranean zone, the wellhead comprising an uphole wellhead end configured to extend upward from the entrance and a downhole wellhead end configured to extend downhole into the wellbore, the wellhead defining an opening extending from the uphole wellhead end to the downhole wellhead end;

a spacer tool attached to the downhole wellhead end, the spacer tool comprising an uphole spacer tool end attached to the downhole wellhead end of the wellhead and a downhole spacer tool end extending downhole into the wellbore, the spacer tool defining a tapered opening tapering from the uphole spacer tool end toward the downhole spacer tool end; and a master valve attached to the downhole spacer tool end of the spacer tool, the master valve defining a flow pathway fluidically coupled to the opening defined by the wellhead and the tapered opening defined by the spacer tool.

2. The tool of claim 1, wherein an inner diameter of the tapered opening at the uphole spacer tool end is greater than an inner diameter of the tapered opening at the downhole spacer tool end.

3. The tool of claim 2, further comprising coiled tubing configured to be lowered through the wellbore tool to a downhole location downhole of the master valve.

4. The tool of claim 3, wherein an outer diameter of the coiled tubing is less than the inner diameter of the tapered opening at the downhole spacer tool end.

5. The tool of claim 3, further comprising a well tool attached to an end of the coiled tubing and configured to be lowered through the wellbore tool to the downhole location.

6. The tool of claim 5, wherein an outer diameter of the downhole tool is less than the inner diameter of the tapered opening at the downhole spacer tool end.

7. The tool of claim 1, wherein an inner diameter of the tapered opening decreases from the uphole spacer tool end toward the downhole spacer tool end to form a substantially smooth tapered opening without shoulders protruding radially inward into the tapered opening.

8. A method comprising:

forming a wellbore tool comprising:

a wellhead configured to be installed at an entrance to a wellbore formed through a subterranean zone, the wellhead comprising an uphole wellhead end configured to extend upward from the entrance and a downhole wellhead end configured to extend downhole into the wellbore, the wellhead defining an opening extending from the uphole wellhead end to the downhole wellhead end, a spacer tool attached to the downhole wellhead end, the spacer tool comprising an uphole spacer tool end attached to the downhole wellhead end of the wellhead and a downhole spacer tool end extending downhole into the wellbore, the spacer tool defining a tapered opening tapering from the uphole spacer tool end toward the downhole spacer tool end, and a master valve attached to the downhole spacer tool end of the spacer tool, the master valve defining a flow pathway fluidically coupled to the opening defined by the wellhead and the tapered opening defined by the spacer tool; and installing the wellbore tool within the wellbore.

9. The method of claim 8, further comprising forming the spacer tool to have an inner diameter decrease from the uphole spacer tool end toward the downhole spacer tool end forming a substantially smooth tapered opening without shoulders protruding radially inward into the tapered opening.

10. The method of claim 8, further comprising forming the spacer tool to have an inner diameter at the uphole spacer tool end greater than an inner diameter of the tapered opening at the downhole spacer tool end.

11. The method of claim 10, further comprising:

forming a coiled tubing, wherein an outer diameter of the coiled tubing is less than the inner diameter of the tapered opening at the downhole spacer tool end; and passing the coiled tubing through the wellbore tool to a downhole location within the wellbore.

12. The method of claim 11, further comprising:

attaching a well tool to an end of the coiled tubing, wherein an outer diameter of the well tool is less than the inner diameter of the tapered opening at the downhole spacer tool end; and lowering the well tool attached to the end of the coiled tubing through the wellbore tool to the downhole location.

* * * * *